US009359169B2

(12) United States Patent
Koba

(10) Patent No.: US 9,359,169 B2
(45) Date of Patent: Jun. 7, 2016

(54) ELEVATOR GROUP CONTROL SYSTEM THAT CONTROLS HALL DESTINATION CALLS FOR ASSIGNED AND NON-ASSIGNED ELEVATOR CALLS

(75) Inventor: Yoshimasa Koba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 459 days.

(21) Appl. No.: 13/994,769

(22) PCT Filed: Jan. 26, 2011

(86) PCT No.: PCT/JP2011/051437

§ 371 (c)(1),
(2), (4) Date: Jun. 17, 2013

(87) PCT Pub. No.: WO2012/101769

PCT Pub. Date: Aug. 2, 2012

(65) Prior Publication Data

US 2013/0264150 A1 Oct. 10, 2013

(51) Int. Cl.
*B66B 1/18* (2006.01)
*B66B 1/24* (2006.01)

(52) U.S. Cl.
CPC ..... *B66B 1/2458* (2013.01); *B66B 2201/103* (2013.01); *B66B 2201/211* (2013.01); *B66B 2201/233* (2013.01); *B66B 2201/403* (2013.01)

(58) Field of Classification Search
CPC ..... B66B 1/2458; B66B 2201/103; B66B 2201/211; B66B 2201/403; B66B 2201/233
USPC ..... 187/247, 380–388, 391–393
See application file for complete search history.

(56) References Cited

U.S. PATENT DOCUMENTS 4,691,808 A 9/1987 Nowak et al.
4,852,696 A * 8/1989 Fukuda ..... B66B 3/008 187/392

(Continued)

FOREIGN PATENT DOCUMENTS

CN 101209790 A 7/2008
JP 52 29057 3/1977

(Continued)

OTHER PUBLICATIONS

International Preliminary Report on Patentability issued Aug. 8, 2013 in Application No. PCT/JP2011/051437 (English Translation).

(Continued)

*Primary Examiner* — Anthony Salata
(74) *Attorney, Agent, or Firm* — Oblon, McClelland, Maier & Neustadt, L.L.P.

(57) ABSTRACT

There is provided an elevator group control system, in which even after an assigned car has been determined, the assigned car can be changed as necessary, and therefore comfortable service can be offered to a user. This group control system includes a call registration device by the use of which a user registers a hall destination call before getting into a car, a car position detection part for detecting the car position of each elevator, and a call registration storage part for storing, for each elevator, a hall destination call having been registered. When a hall destination call having the same contents as those of an already registered hall destination call stored in the call registration storage part is registered newly from the call registration device, if a non-assigned car has already arrived at the floor on which the call registration device is installed, the newly registered hall destination call is assigned to the non-assigned car.

8 Claims, 2 Drawing Sheets

(56) References Cited

U.S. PATENT DOCUMENTS

| | | | | |
|---|---|---|---|---|
| 6,065,570 | A * | 5/2000 | Friedli | B66B 1/2458 187/387 |
| 6,360,849 | B1 * | 3/2002 | Hikita | B66B 1/18 187/381 |
| 6,655,501 | B2 * | 12/2003 | Kostka | B66B 1/2458 187/247 |
| 7,032,716 | B2 * | 4/2006 | Meyle | B66B 1/2458 187/249 |
| 7,392,883 | B2 * | 7/2008 | Hikita | B66B 1/2466 187/249 |
| 7,416,057 | B2 * | 8/2008 | Kostka | B66B 1/18 187/382 |
| 7,694,781 | B2 * | 4/2010 | Sorsa | B66B 1/2458 187/382 |
| 7,975,808 | B2 * | 7/2011 | Smith | B66B 1/2458 187/247 |
| 7,987,947 | B2 * | 8/2011 | Christy | B66B 1/468 187/249 |
| 8,210,321 | B2 * | 7/2012 | Finschi | B66B 1/14 187/388 |
| 8,286,755 | B2 * | 10/2012 | Eto | B66B 1/2458 187/381 |
| 8,490,754 | B2 * | 7/2013 | Amano | B66B 1/2458 187/384 |
| 2003/0164267 | A1 | 9/2003 | Hikita | |

FOREIGN PATENT DOCUMENTS

| | | |
|---|---|---|
| JP | 61 166474 | 7/1986 |
| JP | 63 147786 | 6/1988 |
| JP | 63 218484 | 9/1988 |
| JP | 63 282090 | 11/1988 |
| JP | 8 217342 | 8/1996 |
| JP | 2003-292256 A | 10/2003 |
| JP | 2006-312526 | 11/2006 |
| JP | 2007-276961 | 10/2007 |
| JP | 2008-50112 | 3/2008 |
| JP | 2008 162764 | 7/2008 |
| JP | 2010-150013 | 7/2010 |
| WO | 03 000579 | 1/2003 |

OTHER PUBLICATIONS

Written Opinion issued May 24, 2011 in International Application No. PCT/JP2011/051437 (English Translation).

Japanese Office Action issued Apr. 30, 2014, in Japan Patent Application No. 2012-554560 (with English translation).

International Search Report Issued May 24, 2011 in PCT/JP11/051437 Filed Jan. 26, 2011.

Office Action issued Nov. 26, 2014 in Korean Patent Application No. 10-2013-7022075 (with English translation).

Office Action and Search Report issued on May 20, 2014 in the corresponding Chinese Patent Application No. 201180062436.8 (with Partial English translation and Translation of Category of Cited Documents).

* cited by examiner

ELEVATOR GROUP CONTROL SYSTEM THAT CONTROLS HALL DESTINATION CALLS FOR ASSIGNED AND NON-ASSIGNED ELEVATOR CALLS

TECHNICAL FIELD

The present invention relates to a group control system that controls a plurality of elevators as one group.

BACKGROUND ART

An elevator group control system controls a plurality of elevators installed in a building as one group.

In some group control systems, a call registration device for registering a hall destination call is installed in an elevator hall (for example, refer to Patent Literatures 1 and 2). In such a system, when a user inputs his/her destination floor at a hall, the hall destination call corresponding to the floor on which the call registration device is installed and the destination floor inputted by the user is registered. In the systems described in Patent Literatures 1 and 2, an indicator is installed above each hall entrance to display service floors of each elevator.

CITATION LIST

Patent Literature

Patent Literature 1: Japanese Patent Laid-Open No. 63-218484

Patent Literature 2: International Publication No. WO2003/000579

SUMMARY OF INVENTION

Technical Problem

In a group control system, based on the situation at the time when a user registers a hall destination call, the car responding to the hall destination call (assigned car) is determined. Therefore, depending on the situation of hall destination call registered thereafter on any other floor, another car may arrive at the hall earlier than the assigned car. In this case, if a call from the hall is not assigned to the car arriving at the hall earlier, no one gets into the car from the hall and the car goes to any other floor.

In order to prevent such a phenomenon, the configuration should be made such that even after an assigned car has been determined, the change of assigned car is made as appropriate, and this change is told to the user who is present in the hall. For example, in the systems described in Patent Literatures 1 and 2, the service floor of every elevator is indicated, so that the user can be notified of the change of assigned car by using the indicator.

In recent years, however, from the viewpoint of security, in some cases, the notification of assigned car is given by the call registration device only (that is, the notification of assigned car is given to only the person himself/herself who registered the call), the information about service floors of each elevator is not given at the hall. Also, if the indicator is installed for every elevator, the cost is increased by this installation. Therefore, from this point of view, the installation of indicator is sometimes failed. In this case, since a notification means for notifying the user of the change of assigned car does not exist, the assigned car cannot be changed, so that there arises a problem that the user who sees a person-less car starting toward another floor feels displeasure.

The present invention was made to solve the above problem, and an object thereof is to provide an elevator group control system, in which even after an assigned car has been determined, the assigned car can be changed as necessary, and therefore comfortable service can be offered to a user.

Solution to Problem

An elevator group control system of the invention is a system which controls a plurality of elevators as one group. The system comprises a call registration device by the use of which a user registers a hall destination call before getting into a car, a car position detection part for detecting the car position of each elevator, a call registration storage part for storing, for each elevator, a hall destination call having been registered, and an assigned car determination part in which when a hall destination call having the same contents as those of an already registered hall destination call stored in the call registration storage part is registered newly from the call registration device, if a non-assigned car to which the already registered hall destination call is not assigned has already arrived at the floor on which the call registration device is installed, the newly registered hall destination call is assigned to the non-assigned car.

Also, an elevator group control system of the invention is a system controls a plurality of elevators as one group. The system comprises a call registration device by the use of which a user registers a hall destination call before getting into a car, a car position detection part for detecting the car position of each elevator, a call registration storage part for storing, for each elevator, a hall destination call having been registered, and an operating panel control part which controls an operating panel provided in an elevator car, and makes the registration of destination call from the operating panel prohibited at normal time. In the case where a hall destination call having the same contents as those of an already registered hall destination call stored in the call registration storage part is registered newly from the call registration device, if a non-assigned car to which the already registered hall destination call is not assigned has already arrived at the floor on which the call registration device is installed, the operating panel control part permits the registration of destination call from the operating panel provided in the non-assigned car.

Advantageous Effect of Invention

According to the present invention, even after an assigned car has been determined, the assigned car can be changed as necessary, and therefore comfortable service can be offered to a user.

DESCRIPTION OF EMBODIMENT

Figure 1:
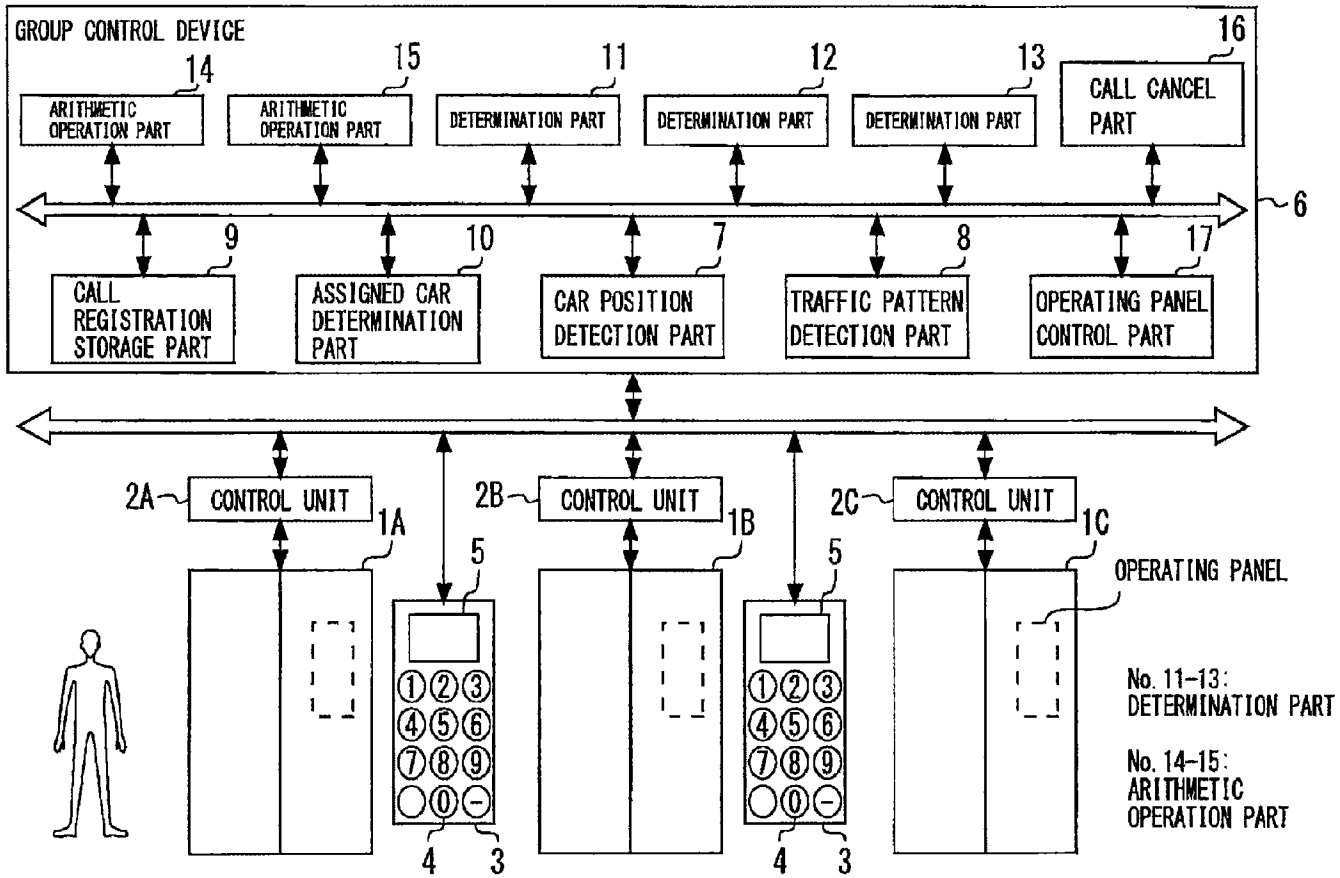
FIG. 1 is a schematic view showing a configuration of an elevator group control system in a first embodiment according to the present invention.

The present invention will be described in more detail with reference to the accompanying drawings. In the drawings, the same signs are applied to the same or equivalent elements, and redundant descriptions thereof are appropriately simplified or omitted.

First Embodiment

FIG. 1 is a schematic view showing a configuration of an elevator group control system in a first embodiment according to the present invention. This group control system controls a plurality of elevators installed in a building as one group. FIG. 1 shows, as one example, the case where this group control system controls three elevators (elevators A to C).

In FIG. 1, reference sign 1 denotes an elevator car, 2 denotes a control unit for controlling the car 1. When the car 1 and the control unit 2 are needed to be identified individually, any of A to C is added to the rear of the sign. For example, the car of elevator A is described as 1A, and the control unit of elevator A is described as 2A.

Reference sign 3 denotes a call registration device installed in an elevator hall of the floors at which the car 1 stops. FIG. 1 shows the case where a plurality of call registration devices 3 are installed in one hall. The call registration device 3 is used for the user to register a hall destination call before getting into the elevator car. For example, the call registration device 3 is provided with input buttons 4 consisting of a ten-key pad and an indicator 5. When the user inputs his/her destination floor by operating the input buttons 4 at the hall, the hall destination call corresponding to the floor on which the call registration device 3 is installed and the destination floor inputted by the user is registered.

Reference sign 6 denotes a group control device for controlling the operations of the plurality of elevators. When determining the car 1 responding to the hall destination call registered from the call registration devices 3 (assigned car), the group control device 6 transmits necessary information to the control unit 2 and the call registration devices 3. For the elevator to which a hall destination call is assigned, based on the information sent from the group control device 6, the control unit 2 causes the car 1 to respond properly to the hall destination call. Also, based on the information sent from the group control device 6, the call registration devices 3 in which the hall destination call has been registered causes the information of the assigned car (for example, elevator No.) to be displayed on the indicator 5 for a predetermined time period.

The group control device 6 includes a car position detection part 7, a traffic pattern detection part 8, a call registration storage part 9, an assigned car determination part 10, determination parts 11 to 13, arithmetic operation parts 14 and 15, a call cancel part 16, and an operating panel control part 17.

The car position detection part 7 has a function of detecting the position of the car 1 of each elevator. The function of the car position detection part 7 can be realized also by detecting the position of the car 1 in each elevator and by transmitting only the detected position information to the group control device 6. Also, the car position can be detected also by using the calculation result of the arithmetic operation part 14, described later.

The traffic pattern detection part 8 has a function of detecting the traffic pattern of the elevators controlled by the group control device 6. The traffic pattern detection part 8 detects a predetermined congestion state based on the traffic volume of elevators. For example, the traffic pattern detection part 8 detects the congestion state when the number of hall determination calls sent from the call registration devices 3 within a predetermined time period exceeds a predetermined number. The congestion state may be detected by using the detection value of a car load weighing device (not shown).

The call registration storage part 9 has a function of storing, for each elevator, the hall destination call having been registered at that time.

The assigned car determination part 10 has a function of assigning the hall destination call registered from the call registration device 3 to the proper car 1. The assigned car determination part 10 determines the car 1 caused to respond to the hall destination call (assigned car) based on the determination results of the determination parts 11 to 13, the calculation results of the arithmetic operation parts 14 and 15, and other necessary pieces of information.

After the assigned car has been determined by the assigned car determination part 10, that information is transmitted to the call registration storage part 9, and new storage contents are added in the call registration storage part 9.

The determination parts 11 to 13 each have a function of making various determinations necessary when the assigned car determination part 10 determines an assigned car. The specific function of the determination parts 11 to 13 will be described later. The determination parts 11 to 13 may be configured as one function of the assigned car determination part 10.

The arithmetic operation part 14 has a function of calculating, for each elevator when a hall destination call is registered from the call registration device 3, the time period before the car 1 arrives at the floor on which that call registration device 3 is installed. When the arrival time estimated by the arithmetic operation part 14 is zero, the car 1 of that elevator has already arrived at the floor on which the call registration device 3 is installed.

The arithmetic operation part 15 has a function of calculating a predetermined assignment evaluation value.

The call cancel part 16 has a function of canceling an already registered hall destination call under predetermined conditions.

The operating panel control part 17 has a function of controlling an operating panel (not shown) provided in the car 1 of each elevator. The operating panel in the car 1 is provided with, for example, destination buttons corresponding to the floors at which the car 1 stops, a door open button, and a door close button. At normal time, the operating panel control part 17 makes the function of the operating panel invalid. When the operating panel is set invalid, a user cannot register a destination call from the operating panel in the car 1. Also, when predetermined conditions are met, the operating panel control part 17 makes the function of the operating panel valid. If the operating panel is set valid, a user comes to be able to register a destination call from the operating panel in the car 1.

Figure 2:
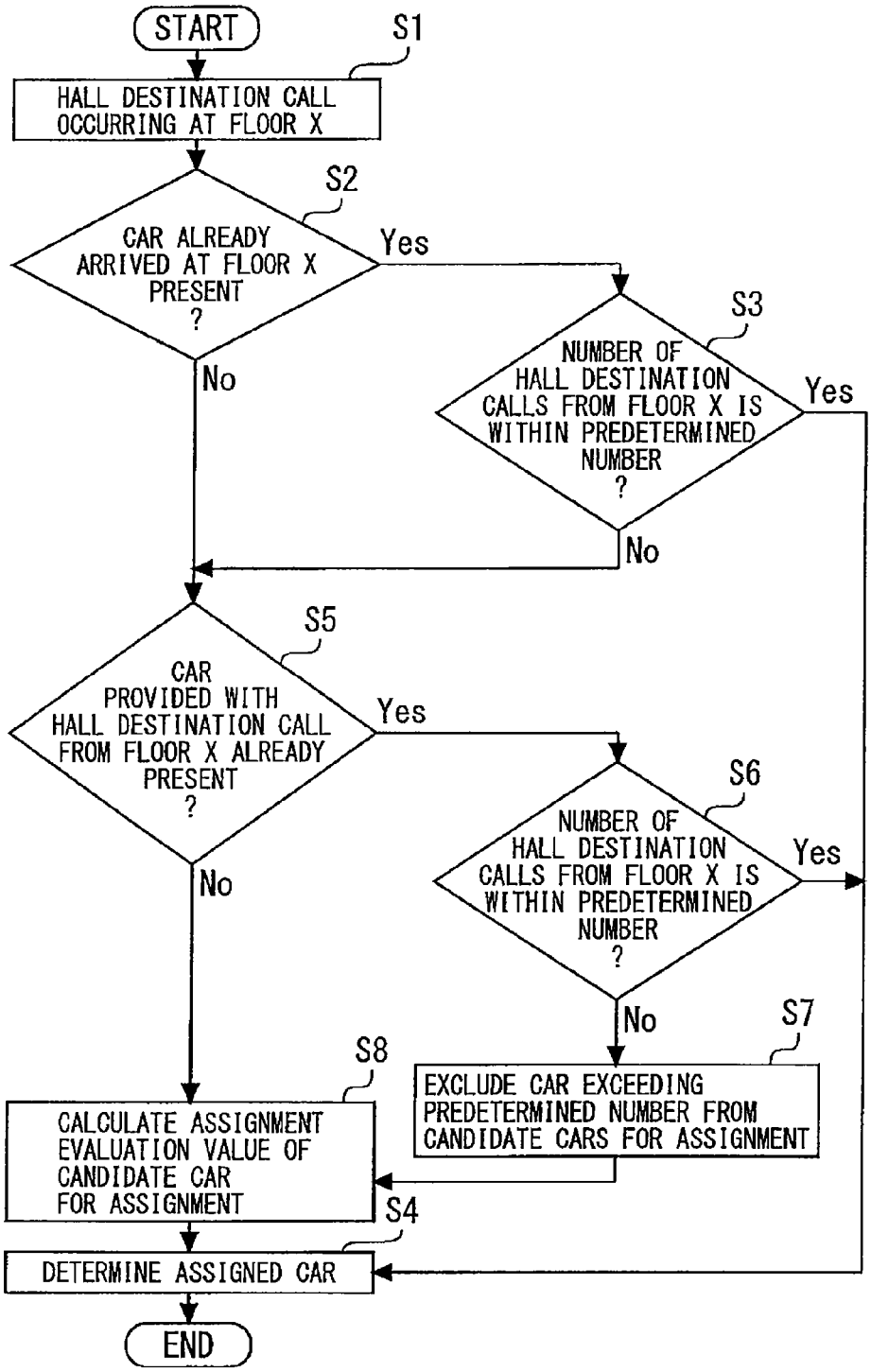
FIG. 2 is a flowchart showing the motion of the elevator group control system in the first embodiment according to the present invention.

Next, referring to FIG. 2, the motion of this group control system (especially, the function of the group control device 6) is explained specifically. FIG. 2 is a flowchart showing the motion of the elevator group control system in the first embodiment according to the present invention.

When a user inputs a destination floor from the call registration device 3 at an elevator hall of a certain floor X, a hall destination call occurs at floor X (S1). This hall destination call is transmitted from the call registration device 3 to the group control device 6. In the group control device 6, the position of each car 1 has been detected by the car position detection part 7. In the group control device 6, on receipt of the hall destination call from the call registration device 3, the determination part 11 determines, based on the detection result of the car position detection part 7, whether or not the car 1 that has already arrived at the floor on which the hall destination call has been registered newly (that is, floor X) is present (S2).

For example, a case is considered in which after a certain user has registered a hall destination call at floor X, the user registers a hall destination call having the same contents again at floor X before getting into the car 1 to which that hall destination call is assigned (a case where a user inputs the same destination floor again at the same floor). If the assigned car has not yet responded to the beforehand registered hall destination call, the already registered hall destination call has been stored in the call registration storage part 9. Therefore, when the hall destination call is registered newly in S1, if the car 1 stopping at floor X is present in the state in which the already registered hall destination call has been stored in the call registration storage part 9 (Yes in S2), the car 1 stopping at floor X is not a car to which the already registered hall destination call has been assigned (hereinafter, referred to an "already assigned car"), but is a car to which the already registered hall destination call has not been assigned (hereinafter, referred to a "non-assigned car").

If the car 1 stopping at floor X is present in S2, the assigned car determination part 10 assigns the newly registered hall destination call to the non-assigned car stopping at floor X according to the determination result in S3 (S4). When the assigned car is determined in S4, the information about assigned car is displayed on the indicator 5 of the call registration device 3 on floor X. That is, when any other car 1 arrives at the hall earlier than the user's assigned car, the user can change the call assignment to the car 1 arrived earlier at the hall by inputting the destination floor again.

In S3, based on the storage contents of the call registration storage part 9, the determination part 12 determines whether or not the number of hall destination calls from floor X assigned to the car 1 stopping at floor X is within a predetermined number. If it is determined in S3 that the number of hall destination calls is within the predetermined number, the assignment processing in S4 is performed.

When a hall destination call is newly registered in S1, the arithmetic operation part 14 calculates, for each elevator, the time period before the car 1 arrives at floor X. Therefore, in S2, based on the calculation result of the arithmetic operation part 14, the determination part 11 may determine whether or not a non-assigned car arriving at floor X within a predetermined time period is present. In the case of this configuration, the range of reassignment can be extended to the car 1 that stops at the hall immediately thereafter.

Also, if it is determined, as the result of calculation performed by the arithmetic operation part 14, that the already assigned car arrives at floor X within a predetermined time period, even when a non-assigned car stopping at floor X is present, the newly registered hall destination call may be assigned preferentially to the already assigned car.

If determination of No is made in S2 or S3, in the group control device 6, the determination part 13 determines whether or not the car 1 to which the hall destination call from floor X has already been assigned is present (S5). For the car 1 provided with the hall destination call from floor X (Yes in S5), next, the determination part 12 determines whether or not the number of hall destination calls from floor X is within a predetermined number (S6). Then, the assigned car determination part 10 determines that the car 1 for which it is determined in S6 that the number of hall destination calls from floor X is within the predetermined number is an assigned car corresponding to the newly registered hall destination call (S4).

On the other hand, the car 1 for which it is determined in S6 that the number of hall destination calls from floor X exceeds the predetermined number is excluded from the candidate cars for assignment by the assigned car determination part 10 (S7). For example, the car 1 for which determination of No is made in S3 is excluded from the candidate cars for assignment in S7.

If determination of No is made in S5 or S6, in the group control device 6, the arithmetic operation part 15 calculates the predetermined assignment evaluation value of each candidate car for assignment (S8). Then, based on the assignment evaluation value calculated by the arithmetic operation part 15, the assigned car determination part 10 determines the car 1 caused to respond to the newly registered hall destination call (S4).

For the group control system having the above-described configuration, even after an assigned car has been determined once, the assigned car can be changed as appropriate by the re-input of destination floor performed by the user, and therefore comfortable service can be offered to the user. Also, for this system, even when there is provided no equipment for telling the information about the floor at which the elevator car stops to the whole of the hall, the change of assigned car and the notification of that change can be made properly. It is a matter of course that this system can be applied to an elevator system provided with equipment that displays the service floor for each elevator.

If the assigned car is changed at the traffic volume peak time such as the time to go to work and the time to leave from work, it is also thought that the operation efficiency of elevator decreases significantly. Therefore, if the congestion state is detected by the traffic pattern detection part 8, the change of assigned car may be prohibited. In such a case, for example, if the same hall destination call is registered newly in S1, the assigned car determination part 10 assigns the newly registered hall destination call preferentially to the already assigned car to which the already registered hall destination call has been assigned.

Also, if the newly registered hall destination call is assigned to a non-assigned car by the assigned car determination part 10, the already assigned car need not be caused to respond to the already registered hall destination call. In such a case, therefore, the configuration may be made such that the already registered hall destination call stored in the call registration storage part 9 is canceled by the call cancel part 16.

However, it is also thought that the already registered hall destination call and the newly registered hall destination call are registered by different users. Therefore, in the case where the call registration device 3 is provided with an authentication device (not shown) for performing personal authentication, when the already registered hall destination call and the newly registered hall destination call are registered by the identical user, and the newly registered hall destination call is assigned to a non-assigned car, the already registered hall destination call stored in the call registration storage part 9 may be canceled by the call cancel part 16.

Also, the use of the operating panel provided in the car 1 is basically prohibited by the operating panel control part 17. However, when a hall destination call having the same contents as those of the already registered hall destination call is registered newly, and a non-assigned car arrives at the floor on which the call registration device 3 is installed before the arrival of the already assigned car, the operating panel of the non-assigned car may be made valid by the operating panel control part 17. Also, even in the case where the non-assigned car arrives early at the floor on which the call registration device 3 is installed, for example, when a congestion state is detected by the traffic pattern detection part 8, the prohibition of call registration may be continued without making the operating panel of the non-assigned car valid.

INDUSTRIAL APPLICABILITY

The elevator group control system according to the present invention can be applied to a system provided, in an elevator hall, with a call registration device for registering a hall destination call.

REFERENCE SIGNS LIST

1 car
2 control unit
3 call registration device
4 input button
5 indicator
6 group control device
7 car position detection part
8 traffic pattern detection part
9 call registration storage part
10 assigned car determination part
11-13 determination part
14, 15 arithmetic operation part
16 call cancel part
17 operating panel control part

The invention claimed is:

1. An elevator group control system which controls a plurality of elevators as one group, comprising:

a call registration device by the use of which a user registers a hall destination call before getting into a car;

a car position detection part for detecting the car position of each elevator;

a call registration storage part for storing, for each elevator, a hall destination call having been registered;

an assigned car determination part in which when a hall destination call having the same contents as those of an already registered hall destination call stored in the call registration storage part is registered newly from the call registration device, if a non-assigned car to which the already registered hall destination call is not assigned has already arrived at the floor on which the call registration device is installed, the newly registered hall destination call is assigned to the non-assigned car; and an operating panel control part which controls an operating panel provided in an elevator car, and makes the registration of destination call from the operating panel prohibited at normal time, wherein the call registration device is provided with an indicator, and when the assigned car determination part assigns a car in response to a registered hall destination call, the information about that assigned car is displayed on the indicator for a predetermined time period.

2. The elevator group control system according to claim 1, further comprising:

an arithmetic operation part in which when a hall destination call is registered from the call registration device, the time period before a car arrives at the floor on which the call registration device is installed is calculated, wherein when a non-assigned car to which the already registered hall destination call is not assigned arrives at the floor on which the call registration device is installed within a predetermined time period, the assigned car determination part assigns the newly registered hall destination call to the non-assigned car.

3. The elevator group control system according to claim 1, further comprising:

an arithmetic operation part in which when a hall destination call is registered from the call registration device, the time period before a car arrives at the floor on which the call registration device is installed is calculated, wherein when an already assigned car to which the already registered hall destination call is assigned arrives at the floor on which the call registration device is installed within a predetermined time period, the assigned car determination part assigns the newly registered hall destination call preferentially to the already assigned car.

4. The elevator group control system according to claim 1, further comprising:

a traffic pattern detection part for detecting a predetermined congestion state based on the traffic volume of elevators, wherein when a congestion state is detected by the traffic pattern detection part, the assigned car determination part assigns the newly registered hall destination call preferentially to an already assigned car to which the already registered hall destination call is assigned.

5. The elevator group control system according to claim 1, further comprising:

a call cancel part for canceling the already registered hall destination call when the newly registered hall destination call is assigned to the non-assigned car.

6. The elevator group control system according to claim 1, further comprising:

an authentication device provided in the call registration device to perform personal authentication; and a call cancel part for canceling the already registered hall destination call when the already registered hall destination call and the newly registered hall destination call are registered by an identical user, and the newly registered hall destination call is assigned to the non-assigned car.

7. An elevator group control system which controls a plurality of elevators as one group, comprising:

a call registration device by the use of which a user registers a hall destination call before getting into a car;

a car position detection part for detecting the car position of each elevator;

a call registration storage part for storing, for each elevator, a hall destination call having been registered; and an operating panel control part which controls an operating panel provided in an elevator car, and makes the registration of destination call from the operating panel prohibited at normal time, wherein in the case where a hall destination call having the same contents as those of an already registered hall destination call stored in the call registration storage part is registered newly from the call registration device, if a non-assigned car to which the already registered hall destination call is not assigned has already arrived at the floor on which the call registration device is installed, the operating panel control part permits the registration of destination call from the operating panel provided in the non-assigned car.

8. The elevator group control system according to claim 7, further comprising:

a traffic pattern detection part for detecting a predetermined congestion state based on the traffic volume of elevators, wherein in the case where a congestion state is detected by the traffic pattern detection part, even if a non-assigned car has already arrived at the floor on which the call registration device is installed, the operating panel control part prohibits the registration of destination call from the operating panel provided in the non-assigned car.

* * * * *